United States Patent [19]

Parizek

[11] Patent Number: 4,789,410

[45] Date of Patent: Dec. 6, 1988

[54] METHOD FOR HEAT TREATING AND QUENCHING COMPLEX METAL COMPONENTS USING SALT BATHS

[75] Inventor: Robert J. Parizek, North Palm Beach, Fla.

[73] Assignee: United Technologies Corporation, Hartford, Conn.

[21] Appl. No.: 21,084

[22] Filed: Mar. 3, 1987

[51] Int. Cl.[4] ..... C21D 1/46

[52] U.S. Cl. ..... 148/20; 148/162

[58] Field of Search ..... 148/15, 15.5, 20, 13.1, 148/162

[56] References Cited

U.S. PATENT DOCUMENTS 4,583,720 4/1986 Kunzli et al. ..... 266/81

FOREIGN PATENT DOCUMENTS 72525 2/1983 European Pat. Off. ..... 266/120

*Primary Examiner*—Christopher W. Brody

[57] ABSTRACT

Salt bath techniques are used to heat treat and quench a metal component. The component is first heated to the required heat treatment temperature while disposed within a sealed, first salt bath. Then, while still within the first salt bath, the component is quenched into a second salt bath. Heat is rapidly and uniformly transferred from the hot, first salt bath to the cool, second salt bath, and from the component to the first salt bath. The uniform rate of heat transfer minimizes any undesired stresses on the component, and permits components having complex geometries to be heat treated and quenched without distortion or cracking.

6 Claims, 1 Drawing Sheet

METHOD FOR HEAT TREATING AND QUENCHING COMPLEX METAL COMPONENTS USING SALT BATHS

This invention was made with U.S. Government support under a contract awarded by the Department of the Army. The government has certain rights in this invention.

TECHNICAL FIELD

This invention relates to the heat treatment of metal components. In particular, it relates to the heat treatment of integrally bladed rotors using salt baths.

BACKGROUND

Metal components are commonly heat treated to establish their metallurgical and mechanical properties. Heat treatment parameters which influence the properties obtained include the rate at which the component is heated and then cooled, and the time and temperature at which the component is held.

The configuration of the component exerts an influence on the ability to achieve the desired heat treated properties. Components having a relatively simple geometry and sections of constant thickness are, in general, considerably easier to heat treat than are complex geometry components with widely varying section thicknesses. For example, in complex components, even though an overall rate of temperature change is imposed upon the component (e.g., the rate at which the temperature of the heat treatment furnace is raised), thin component sections heat up at a faster rate than more massive, thick component sections. This phenomenon also occurs when the component is cooled: thin sections cool faster than thick sections. Due to the different heating (or cooling) rates which the various sections of a complex component experience during heat treatment, the properties of thin sections may differ from the properties of thick sections. Also, if the heating (or cooling) rates of thick and thin sections are significantly different, the component may distort, or even crack, as the component is heat treated.

Integrally bladed rotors (IBR) are an example of complex metal components which are used in some gas turbine engines. See, e.g., commonly assigned U.S. Pat. No. 4,479,293 to Miller et al, and the patents referenced therein. One advantage provided by IBR rotor designs over conventional blade and disk designs is that an IBR is a one piece component, as opposed to the conventional assembly of a plurality of individual blades in a disk. The one piece IBR is therefore less prone to vibration damage and some of the other known disadvantages of conventional rotors.

In some IBRs the hub section is substantially more massive than are the blades which extend radially outwardly from the hub. Differences in section thickness of two orders of magnitude between the hub and blades are not uncommon. Accordingly, the heat treatment of such complex geometry components is difficult, for the reasons discussed above. In particular, it is difficult to achieve the heating and cooling rates required of the thick hub section without causing distortion and/or cracking of the thin blades.

The prior art shows several techniques for controlling the cooling rate during the heat treatment of metal components. See, for example, U.S. Pat. Nos. 3,558,367 to Eck and 3,703,093 to Komatsu et al. However, these techniques are useful only with components having relatively simple designs. Accordingly, improved techniques are needed, especially for complex geometry components like IBRs, which have nonuniform section thicknesses.

SUMMARY OF THE INVENTION

According to this invention, a complex geometry metal component is heat treated and quenched in such a manner that differences in temperature between thick and thin component sections during these operations are minimized. As a result, distortion and cracking of the component during its heat treatment can be prevented.

Salt bath techniques are utilized in this invention to equalize the rate at which the temperature of thick and thin component sections change during the heat treatment operation. This is accomplished by sealing the component within a salt bath (the "component salt bath") and heating the component salt bath and the component therewithin to the desired heat treatment temperature. Then, after holding at the desired temperature for the required period of time, the component bath (the component still sealed within it) is quenched into another salt bath (the "quench salt bath"). Heat is transferred rapidly and uniformly, first from the component bath to the quench bath, and then from the component to the component bath. Because of the uniform rate at which heat is transferred from the component to the component bath, all sections of the component cool at approximately the same rate, and distortion and cracking of the component can be avoided.

The invention will be better understood by reference to the following drawings and description of the best mode for carrying out the invention.

BEST MODE MODE FOR CARRYING OUT THE INVENTION

This invention is particularly useful in the heat treatment (i.e., heating and quenching ) of a complex metal component such as an integrally bladed rotor. While those skilled in the art will appreciate that the invention has utility in heat treating other types of metal components, the invention is described in conjunction with the treatment of an IBR used in a gas turbine engine.

Figure 1:
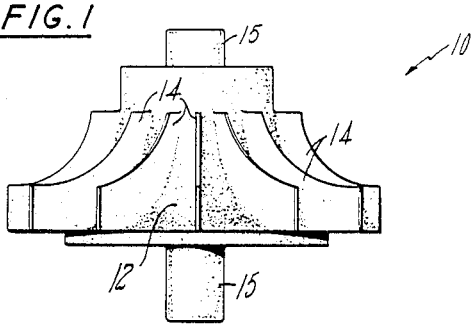
FIG. 1 is a perspective view of an integrally bladed rotor which can be heat treated according to this invention.
Figure 2:
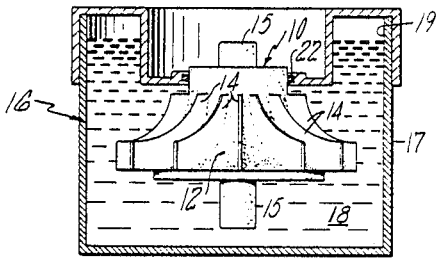
FIGS. 2 and 3 are simplified views of apparatus useful in the invention.

Referring to FIG. 1, an IBR is represented by the general reference numeral 10. Extending radially outwardly from a central hub 12 are a plurality of blades 14. Shafts 15, which are coupled to other components in the gas turbine engine when the engine is assembled, extend axially from the hub 12. As noted above, some IBRs have sections of widely varying thicknesses. With respect to the IBR 10 shown in FIG. 1, the hub 12 is considerably thicker and more massive than are the blades 14. Because of the difference in mass between the hub 12 and the blades 14, IBRs such as the one shown in FIG. 1 cannot readily be heat treated using conventional heat treatment techniques without cracking or distorting the blades 14. Since the hub 12 is typically the most critical structural part of the IBR 10, heat treatment parameters must be tailored so that the required hub properties are achieved. For IBRs made of certain nickel base superalloys, a solution, stabilization, and precipitation heat treatment is typically utilized to obtain such properties. Typical nickel base superalloys include Astroloy, IN718, IN100, Rene 95, and AF2-10A. Generally, the composition of such superalloys fall within the range: 12-22Cr, D-18Co, 2.5-6Mo, 0-4W, 0-4Ta, 0.2-6Al, 0 5-5Ti, 0.01-0.2C, 0.01-0.3B, 0-0.9Zr, 0-1.5V, 0-20Fe, 0-6Cb, balance Ni. In order to achieve the required properties in components made from these types of superalloys, a rapid cooling rate is generally required following the stabilization treatment. According to this invention, in order to minimize the variation in cooling rates between the thick hub 12 and the thin blades 14, and to therefore avoid the possibility that the blades 14 will crack or distort as they cool, the IBR IO is heated to the stabilization temperature and then quenched while at all times sealed within a component salt bath 16 (FIG. 2). The component salt bath 16 comprises a sealed tank or container 17 which holds heat treatment salt 18. The container 17 is configured with a reservoir portion 19 so that the IBR 10 is always in direct contact with the salt 18 while it is stabilization heated and then quenched. Seals for preventing loss of the heat-treatment salt 18 are designated in FIG. 2 with the reference numeral 22 . Continual contact with the salt 18 in the component bath 16 insures that heat is transferred rapidly from the IBR 10 to the salt 18 in the bath 16 during the quench cycle.

Figure 3:
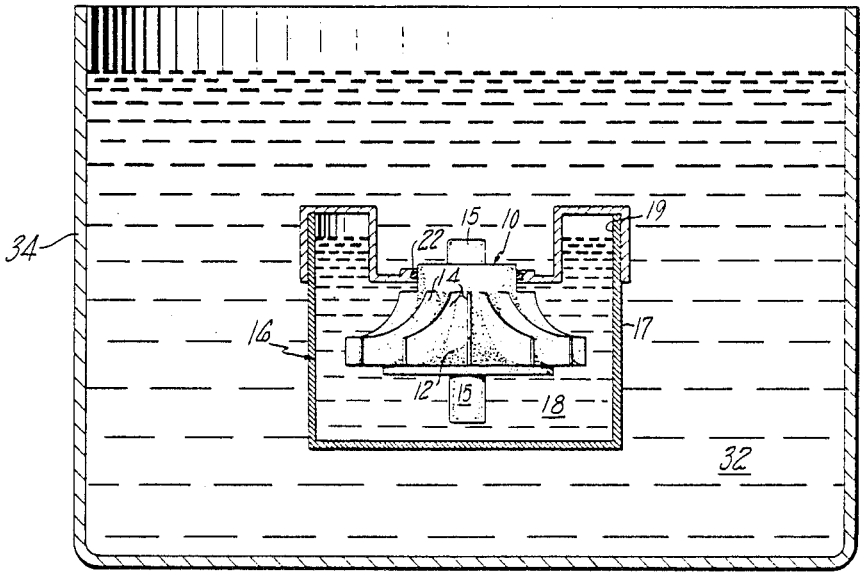

The preferred method for carrying out the stabilization treatment (heating and quenching) is as follows: while the IBR 10 is sealed within the component salt bath 16, the component bath 16 is heated to the stabilization temperature $T_s$ by conventional methods. After holding at $T_s$ for the required period of time, the component bath 16 is quenched into a quench bath 32 within container 34, as shown in FIG. 3. The quench bath 32 is maintained at a temperature $T_q$ which is less than $T_s$. The temperature of the quench bath 32 is chosen so that the quench rate required to achieve the necessary hub properties, after heating at $T_s$, is achieved.

Once the component salt bath 16 is immersed within the quench bath 32, heat is rapidly and uniformly transferred from the component bath 16 to the quench bath 32. As the temperature of the salt 18 in the component bath 16 decreases, heat is also transferred from the IBR 10 to the salt 18. Due to the uniform rate at which heat is conducted from the IBR 10 to the salt 18, the temperature of all sections of the IBR decreases approximately uniformly. As a result, distortion and cracking of the IBR 10 is avoided. Due to the uniform rate at which heat is transferred from the IBR 10 to the salt 18, the cooling rates necessary to achieve the required properties of the IBR hub 12 are achieved.

As an example of the invention, an IBR for a gas turbine engine was fabricated from the alloy AF2-IDA. This alloy is described in Aerospace Materials Specifications (AMS) 5855 and 5856 and has a typical composition, on a weight percent basis, of 11.5-12.5Cr, 9.5-10.-5Co, 2.5-3.5Mo, 5.5-6.5W, 2.75-3.25Ti, 1-2Ta, 4.2-4.-8Al, 0.01-0.02B, 0.05-0.15Zr, 0.3-0.35C, up to 1Fe, balance Ni. According to the aforementioned AMS specifications, components made of this alloy are preferably solution heat treated at 1,205° C. (2,200° F.) for 2 hours; stabilization heat treated at 1,120° C. (2,050° F.) for 2 hours; and precipitation heat treated at 705° C. (1,300° F.) for 12 hours, and then at 815° C. (1,500° F.) for 8 hours. For certain applications, the IBR must be cooled rapidly after the stabilization treatment and air cooled after the solution and precipitation treatments.

In this example, the IBR which was heat treated was about 43 cm (17 in.) in diameter and about 18 cm (7 in.) high. The thickest portion of the hub was about 23 cm (9 in.), and the thinnest portion of the blades was about 0.10 cm (0.05 in.). Thus, the hub and blade thicknesses varied by more than two orders of magnitude.

In order to equalize the cooling rates of the hub 12 and blades 14 while the IBR was quenched after heating to the stabilization temperature (1,120° C.), the IBR 10 was disposed within the component salt bath 16, as shown in FIG. 2. As is seen in the Figure, a portion of the IBR hub 12 protruded from the fixture 16. The remainder of the IBR 10 was sealed within the component bath 16. The component bath 16, and the salt 18 and IBR 10 therewithin were gradually heated to the stabilization temperature of 1,120° C. by conventional heat treatment techniques. The gradual increase in temperature was used in order to avoid thermally shocking the IBR 10, and to remove any moisture which was present in the salt 18. As the temperature of the component bath 16 increased, the temperature of the IBR 10 increased at a similar rate. After the IBR was held at 1,120° C. for two hours, it was quenched into a quench bath 32 maintained at about 540° C. (1,000° F.). The salt bath 32 provided a rapid quench, which was measured to be about 33° C. (60° F.) per minute. While the cooling rate of the blades 14 was likely somewhat higher, there were no quench cracks observed in the blades. The portion of the hub 12 which protruded from the component salt bath 16 was in direct contact with the quench bath 32. This resulted in a more rapid cooling rate in the protruding portion than in the portion of the hub 12 which was sealed within the component bath 16 . Following this stabilization heat treatment, the IBR 10 was then given the aforementioned precipitation heat treatment. Following a final machining operation, the heat treated IBR 10 was ready for use in a gas turbine engine.

Although this invention has been shown and described with respect to a preferred embodiment, it will be understood by those skilled in the art that various changes may be made without departing from the spirit and scope of the claimed invention. The particular parameters for heat treating components fabricated from other alloys will be different than those recited above. However, those skilled in the art will be able to adapt those parameters to the present invention. And while FIG. 3 shows a portion of the hub 12 protruding out of the component salt bath 16, no portion of the IBR must do so. Certain component geometries, like those of an integrally bladed rotor, are especially suited for being heat treated in this fashion. With the hub portion of the rotor protruding from the component salt bath as shown in FIG. 2, a faster hub cooling rate is achieved without adversely affecting the cooling behavior of the remainder of the rotor. Certain components, however, will not be able to be fixtured within the container in the fashion shown in FIG. 2; however, the methods of this invention will still be useful.

I claim:

1. A method for heating and cooling a metal component, comprising the steps of disposing the component in a first salt bath within a first container; heating the first container to a temperature $T_1$, wherein the first salt bath and component therein are raised to the temperature $T_1$; and cooling the first container and the first salt bath and component therewithin by immersing the first container in a second salt bath within a second container such that a portion of the component is in direct contact with the second salt bath, wherein the second salt bath is at a temperature $T_2$ less than $T_1$, and wherein the first salt bath and component therein are cooled to temperature $T_2$.

2. The method of claim 1, wherein the component is a nickel base superalloy.

3. The method of claim 2, wherein the component has a nominal composition 12–22Cr, 0–18Co, 2.5–6Mo, 0–4W, 0–4Ta, 0.2–6Al, 0.5–5Ti, 0.01–0.2C, 0.01–0.3B, 0–0.9Zr, 0–1.5V, 0–20Fe, 0–6Cb, balance Ni.

4. The method of claim 1, wherein the component has a nominal composition of, by weight percent, 12cr-10Co-6W-4.5Al-3Ti-3Mo-1.5Ta-0.3C-0.1Zr-0.015B-balance Ni, $T_1$ is about 1,120° C. and $T_2$ is about 540° C.

5. A method for heat treating and quenching an integrally bladed rotor for a gas turbine engine, the rotor comprising a hub, a rim, and a plurality of circumferentially spaced apart blades extending radially outwardly from the rim, the method comprising the steps of disposing the rotor in salt within a salt bath container such that a portion of the rotor hub protrudes from the container, and sealing the rotor within the container, wherein the protruding portion of the hub is not in direct contact with the salt in the container; heating the container and the salt and component therewithin to a temperature $T_1$; and cooling the container and the salt and component therewithin to a temperature $T_2$ which is less than $T_1$ by quenching the container in a salt bath at temperature $T_2$, wherein during said step of quenching, the protruding portion of the hub directly contacts the quanching salt bath.

6. A method for heating a metal component to a temperature $T_1$ and then cooling the component to a temperature $T_2$ less than $T_1$, comprising the steps of disposing the component in a first salt bath at a temperature less than $T_1$ within a first container, heating the salt bath and the component therein to the temperature $T_1$; and cooling the salt bath and the component therein by immersing the first container into a second salt bath at the temperature $T_2$, wherein the first salt bath and component therein are cooled to temperature $T_2$.

* * * * *